US006981743B2

(12) United States Patent
Edwards et al.

(10) Patent No.: US 6,981,743 B2
(45) Date of Patent: Jan. 3, 2006

(54) CHAIR WITH ADJUSTABLE LUMBAR SUPPORT

(75) Inventors: Tom Edwards, Spring Lake, MI (US); Errol Pearsons, Grand Haven, MI (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 10/865,193

(22) Filed: Jun. 10, 2004

(65) Prior Publication Data

US 2005/0121958 A1 Jun. 9, 2005

Related U.S. Application Data

(63) Continuation-in-part of application No. 29/194,354, filed on Nov. 21, 2003.

(51) Int. Cl.
*A47C 7/46* (2006.01)

(52) U.S. Cl. ..... 297/284.7; 297/284.4

(58) Field of Classification Search ..... 297/284.7, 297/284.4
See application file for complete search history.

(56) References Cited

U.S. PATENT DOCUMENTS

| | | | |
|---|---|---|---|
| 567,096 | A | 9/1896 | Harvey et al. |
| 1,264,265 | A | 4/1918 | Brusius |
| 2,756,809 | A | 7/1956 | Endresen |
| 2,991,124 | A | 7/1961 | Schwarz |
| 3,106,423 | A | 10/1963 | Schwarz |
| 4,097,087 | A | 6/1978 | Garavaglia |
| 4,558,902 | A | 12/1985 | Meiller |
| 4,730,871 | A | 3/1988 | Sheldon |
| 6,126,235 | A | 10/2000 | Grove |
| 6,260,921 | B1 | 7/2001 | Chu et al. |

*Primary Examiner*—Anthony D. Barfield
(74) *Attorney, Agent, or Firm*—Ronald A. Sandler; Jones Day

(57) ABSTRACT

A chair or other seating unit comprises a seat, a backrest, and an adjustable lumbar support, the adjustable lumbar support comprising a lumbar pad and a position adjustment means. The position adjustment means comprises a vertical adjustment means for mounting the lumbar support pad to the back rest, a substantially stationary support means that receives the vertical adjustment means, and a tension adjustment means, that releases the tension between the vertical adjustment means and the substantially stationary support means to allow the lumbar support to be positioned, and that increases the tension to hold the lumbar support means in a preferred selected position. The stationary support means is fixedly secured to the backrest.

7 Claims, 5 Drawing Sheets

CHAIR WITH ADJUSTABLE LUMBAR SUPPORT

This is a continuation-in-part of patent application Ser. No. 29/194,354, filed Nov. 21, 2003.

This invention relates to a chair having an adjustable lumbar support. More particularly, this invention relates to a chair having an adjustable lumbar support, wherein the adjustable lumbar support is movable on a substantially stationary support member.

Chairs and other seating units having adjustable lumbar supports are well-known in the art. Such chairs typically comprise a frame, a seat mounted to said frame, a backrest mounted to said frame, and a plate fastened to the frame for supporting a lumbar support relative to the backrest. Such an arrangement is shown and described, for example, in U.S. Pat. No. 2,991,124, U.S. Pat. No. 3,106,423, and more recently in publication U.S. 2002/0043841 A1. These prior art chairs, while serviceable, suffer from complexity of design and multiplicity of parts. These factors make these chairs more expensive to manufacture, and more laborious to assemble. In addition, the number of mechanical parts and their manner of assembly can diminish the aesthetic appeal of such chairs.

It is thus one object of the invention to provide a seating unit having an adjustable lumbar support, having a simple design that is easy to manufacture and assemble.

It is another object of the invention to provide a seating unit having an adjustable lumbar support having a simple design that is aesthetically pleasing.

It is still another object of the invention to provide an embodiment of a seating unit having an adjustable lumbar support wherein the adjustable lumbar support is adjustably mounted on a stationary support member.

SUMMARY OF THE INVENTION

A chair or other seating unit comprises a seat, a back rest, and an adjustable lumbar support, the adjustable lumbar support comprising a lumbar support pad and a means for adjusting the position of the lumbar support pad. The position adjustment means comprises a stationary support means mounted to the backrest, a vertical adjustment means on which the lumbar support pad is mounted, and a tension adjustment means that is supported by the stationary support means. The tension adjustment means releases the tension between the vertical adjustment means and the stationary support pad means to allow the lumbar support pad to be vertically adjusted, and then increases the tension to hold the lumbar support pad in a preferred selected position. The design is simple, and does not require a separate frame mounted to a backrest. Because no separate frame is required, the design of the backrest can be more aesthetically pleasing.

Other objects, advantages, and novel features of the present invention will be apparent from reading the detailed description of a preferred embodiment set forth below, taken together with the accompanying figures.

DETAILED DESCRIPTION OF THE INVENTION

Figure 1:
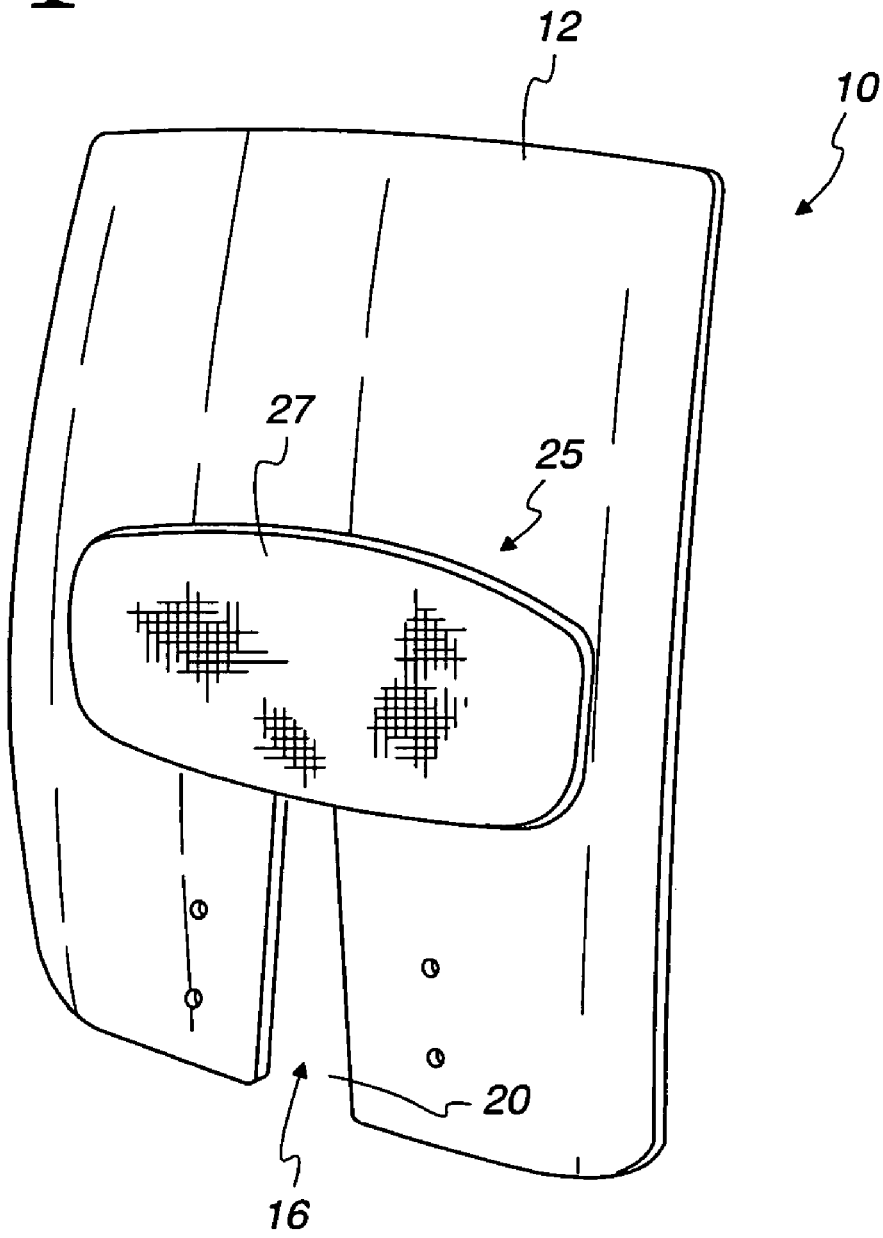
FIG. 1 is a perspective view of a back rest embodying the adjustable lumbar support of the present invention.
Figure 2:
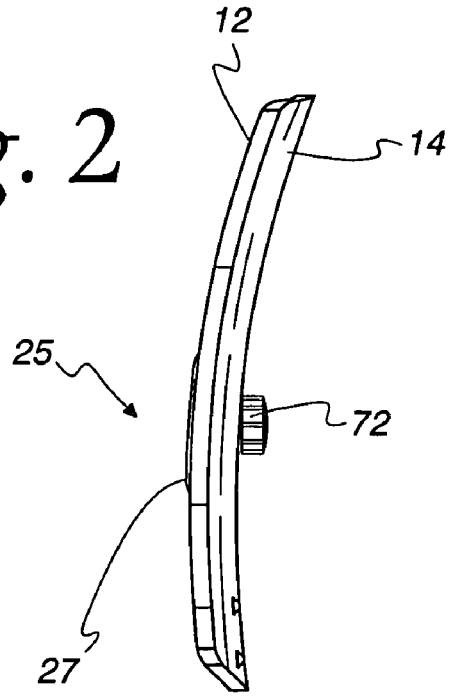
FIG. 2 is a side view of the embodiment of FIG. 1.
Figure 3:
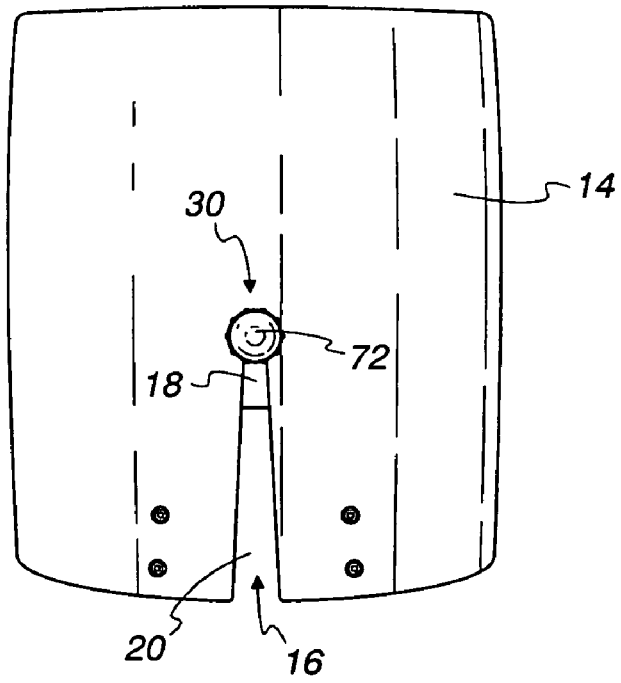
FIG. 3 is a rear view of the embodiment of FIG. 1.
Figure 4:
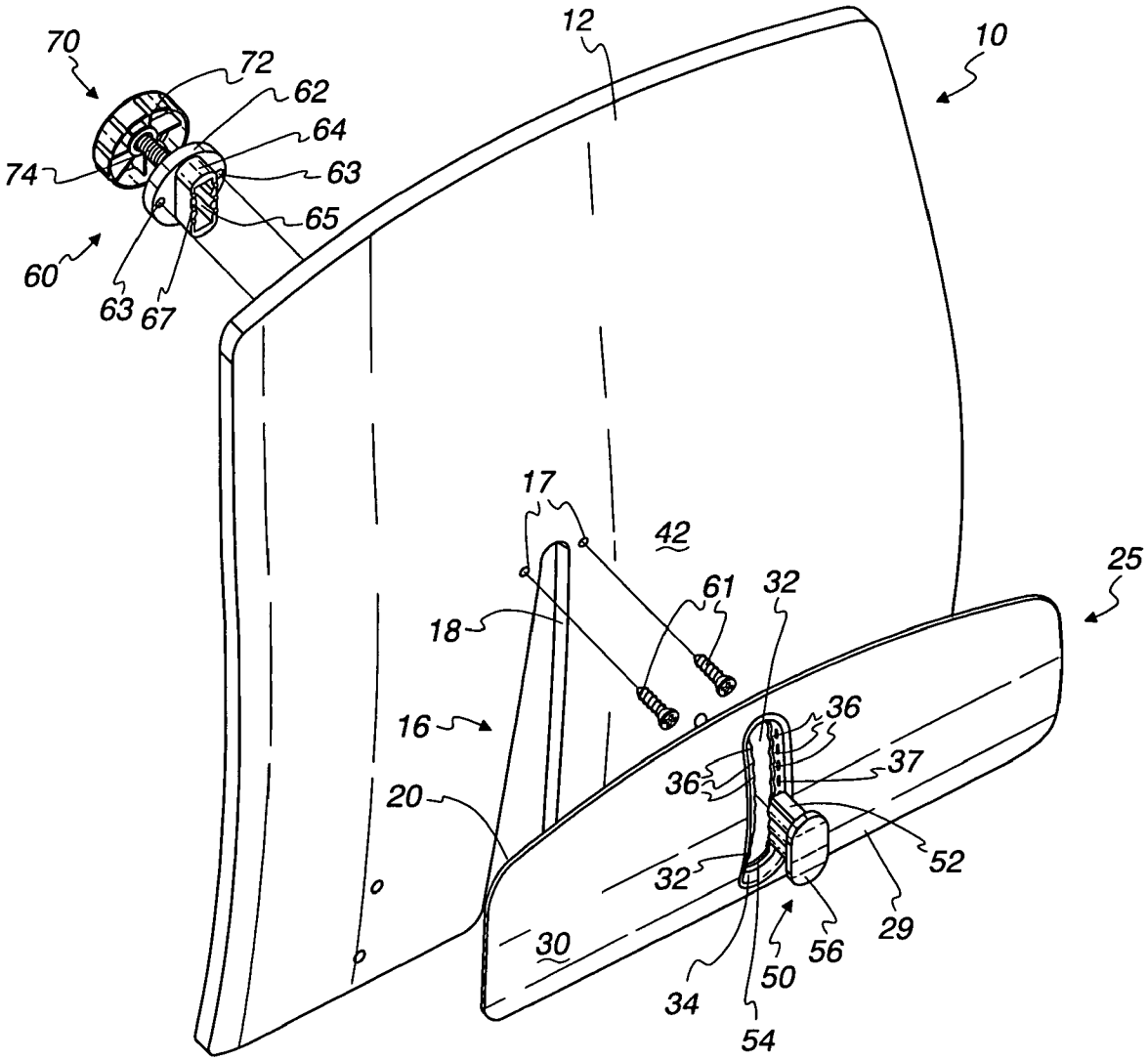
FIG. 4 is an exploded view of the embodiment of FIG. 1, showing the means for adjusting the position of the lumbar support.
Figure 5:
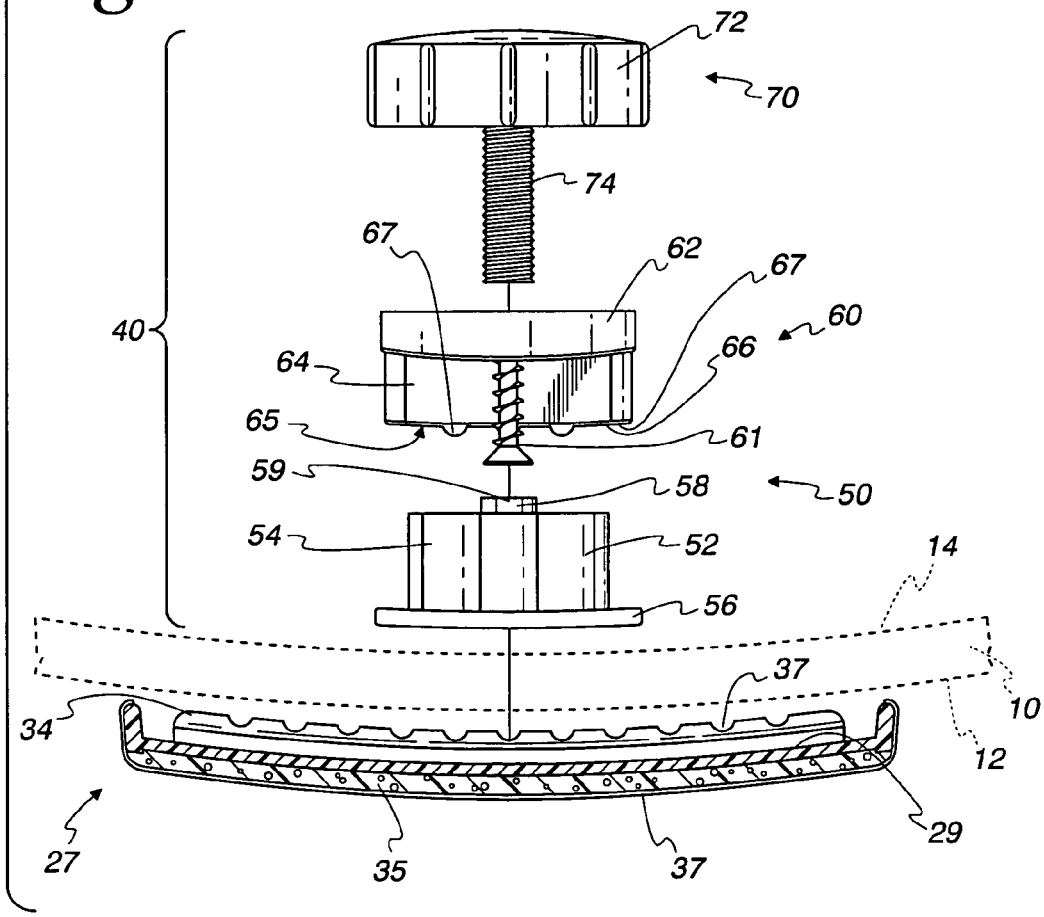
FIG. 5 is an exploded cross-sectional view of an embodiment of the means for adjusting the position of the lumbar support of the present invention.
Figure 6:
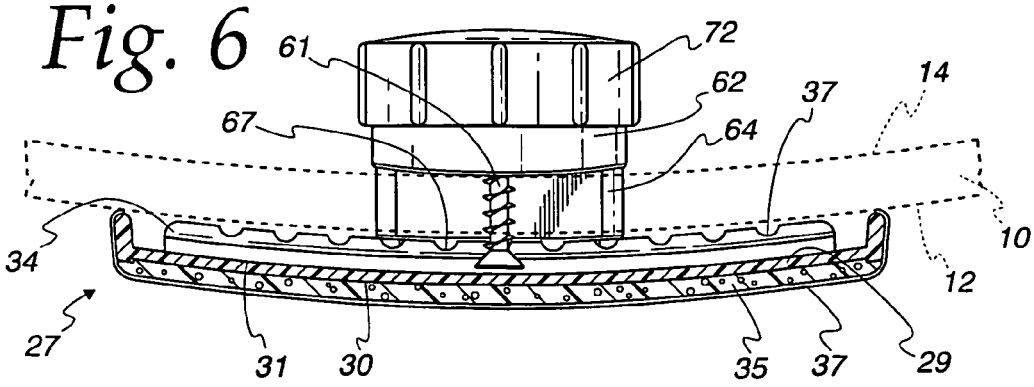
FIG. 6 is an assembled view of the embodiment of FIG. 5.
Figure 7:
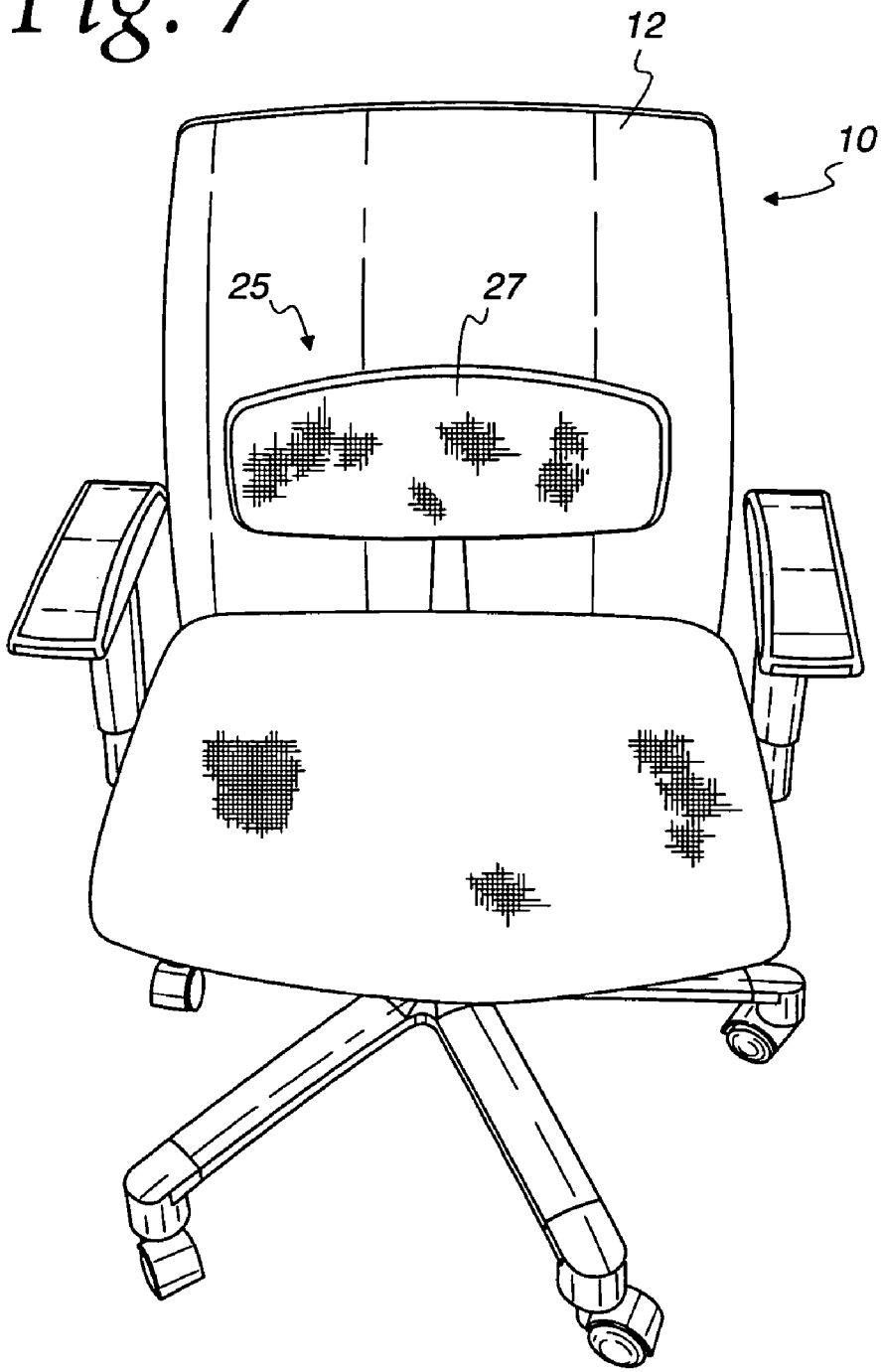
FIG. 7 is a view of an embodiment of a chair comprising an adjustable lumbar support of the present invention.

As illustrated in the Figures, a chair back 10 has a front surface 12 and a rear surface 14. The chair back 10 is preferably of unitary construction, and includes a receiving means 16 integral therewith. In the illustrated embodiment, receiving means 16 is a slot having a narrower upper end 18 and a wider lower end 20, and extends from about the center of backrest 10 down to the bottom of backrest 10. It will be appreciated, however that receiving means 16 can be of any size and shape suitable for receiving a suitable portion of the vertical adjustment means, as shown below. As seen in FIG. 2, backrest 10 can be non-planar and preferably is convex with respect to a user's back, for greater comfort and support for a user.

Lumbar support 25 comprises a pad 27 which has substantially greater width than height, the pad 27 being shaped and dimensioned to fit behind the lumbar region of a person's back and provide support therefor for a person sitting in the chair. Enclosed within the pad is a pad base 29 having a front surface 30 and a rear surface 31. A longitudinal slot 32 extends through pad base 29. The rear surface of slot 32 is provided with an inwardly directed collar 34, the collar 34 having a plurality of scallop-shaped protrusions 36 formed in its radially inner edges, each scallop-shaped protrusion having a small recess or orifice 37 therethrough.

Lumbar support 25 further comprises means 40 for adjusting the position of lumbar support pad 27, the adjustment means 40 comprising vertical adjustment means 50, stationary support means 60, and tension adjustment means 70. As used in this patent, the term "vertical" or "vertical adjustment" is not limited to a direction that is exactly 90 degrees to the horizontal, but is used to indicate that the general direction of motion is along the direction of the spine of a person seated in a chair of the present invention. Thus a pad that moves "vertically" as described herein may move, for example, along an arc that is either convex or concave.

Vertical adjustment means 50 comprises extending member 52 sized and shaped to fit within slot 32 in pad base 29. Extending member 52 has a plurality of axial ridges 54 along the outer surface thereof, said ridges 54 being complementary in size and shape to the protrusions 36 of inwardly directed collar 34 surrounding slot 32 of pad base 29. Vertical adjustment means 50 further comprises a securement plate 56 disposed on the forward facing side of extending member 52, said securement plate 56 being of the same width as longitudinal slot 32 but of shorter length. Securement plate 56 fits in sliding engagement in longitudinal slot 32, the rear surface of securement plate 56 seating against the forward surface of inwardly directed collar 34, the forward surface of securement plate 56 preferably being substantially flush with forward surface 30 of pad base 29. Disposed within extending member 52 is a solid member 58 with a threaded hole 59 therein, the purpose of which will be discussed hereinbelow.

Stationary support means 60 comprises base plate 62 having a front surface that abuts rear surface 14 of chair back 10 and a rear surface that abuts the front surface of adjustment knob 72 of tension controlling means 70. Stationary support means 60 is fixedly secured to chair back 10 in the vicinity of receiving means 16. In the illustrated embodiment, two screws 61 are used, one on either side of receiving means 16, which screws 61 pass through screw holes 17 in backrest 10 and into threaded holes 63 that extend through base plate 62. Other equivalent means of fixedly securing stationary support means 60 to chair back 10 will be readily apparent to those skilled in the art. Extending from the front surface of base plate 62 is a wall member 64 defining a cavity 65. The inner surface 66 of cavity 65 has a form complementary to the axial ridges 54 on extending member 52, which is received in cavity 65. Wall member 64 has a forward edge 67. When assembled together, pad base 29 is mounted to chair back 10 by vertical adjustment means 50, such that extending member 52 fits through longitudinal slot 32 of pad base 29, with inwardly directed collar 34 on the rear surface of longitudinal slot 32 being received in sliding engagement between the rear surface of securement plate 56 and the forward edge 67 of wall member 64. When the user desires to adjust the vertical position of the lumbar support pad 27, the user simply slides the pad up or down. The vertical movement of the pad will be limited by contact with the upper and lower ends of longitudinal slot 32 against extending member 52. The axial ridges 54 on the exterior of extending member 52 fit within the protrusions 36 in collar 34 in friction fit relation, such that the protrusions 36 define fixed increments of vertical adjustment of lumbar pad 27. The vertical adjustment means 50 and the collar 34 of longitudinal slot 32 are each made of a material with sufficient rigidity to maintain their shape and position relative to one another, but with enough flexibility to allow the ridges 54 to slide past protrusions 36 of collar 34.

Once the position of lumbar support pad 27 has been selected, it is desirable to firmly secure the pad in the selected position. Means 70 for adjusting the tension of the vertical adjustment means 50 comprises adjustment knob 72 having a threaded spindle 74 extending forwardly. Adjustment knob 72 is disposed rearwardly of base plate 62 of stationary support means 60. Spindle 74 passes through an orifice in base plate 62 of stationary support means 60 and continues through receiving means 16 in chair back 10, through cavity 65 of stationary support member 60, and into the threaded hole 59 in the solid member 58 inside extending member 52 of mounting means 50, such that the threaded end of spindle 74 engages threaded hole 59.

In operation, when the lumbar support pad 27 has been moved to a desired position, adjustment knob 72 is rotated until the threaded end of spindle 74 is received in threaded hole 59 in extending member 52. At the same time, a plurality of bosses 67 on the forward surface of wall member 64 engages a plurality of small holes or recesses 37 in protrusions 36 of collar 34. When the bosses 67 are engaged in the holes 37 then adjustable lumbar pad 27 is locked in place with respect to adjustment means 40. When a user desires to re-position lumbar pad 27, then the adjustment knob 72 is rotated in the opposite direction. This rotation releases the tension on stationary support means 60 and lumbar pad 27, so that the bosses 67 can disengage from the holes 37 in collar 34. Support pad 27 can then slide vertically, within the limits of longitudinal slot 32, among the discrete locations defined by the protrusions 36. When a preferred location is found, adjustment knob 72 is once again tightened, to secure the pad in place.

The front surface 30 of pad base can be covered with padding 35 such as polyurethane foam. The pad 27 then can be upholstered, such as with fabric 37, the upholstery extending over the padding and around the periphery of pad 27, the upholstery being secured against rear surface 31, as long as the longitudinal slot 32 is left uncovered on rear surface 31.

While a preferred embodiment of the invention has been described, the embodiment is disclosed by way of illustration and not by way of limitation. Those skilled in the art will recognize other embodiments and equivalents within the scope of the invention, which embodiments and equivalents are intended to be covered by the claims appended hereto.

What is claimed is:

1. A chair comprising a seat, a back rest, and a lumbar support, the lumbar support comprising a lumbar support pad and a means for adjusting the position thereof, said means for adjusting the position of said lumbar support pad comprising a vertical adjustment means, a stationary support means mounted to said back rest, and a tension adjustment means, said vertical adjustment means being received in a receiving means integral with said back rest, said stationary support means and said tension adjustment means being disposed rearwardly of said back rest;

wherein said tension adjustment means engages said vertical adjustment means through said stationary support means, and a portion of said lumbar support pad is engaged between said vertical adjustment means and said stationary support means, such that when said tension adjustment means is adjusted to increase tension on said vertical adjustment means, said vertical adjustment means urges said lumbar support pad into more secure engagement with said stationary support means, such that said lumbar pad cannot be moved with respect to said vertical adjustment means.

2. The chair of claim 1, said tension adjustment means being adjustable to decrease tension, such that when said tension is decreased, said lumbar pad is in less secure engagement with said support means and can be moved with respect to said vertical adjustment means.

3. The chair of claim 1 wherein said lumbar support pad comprises a longitudinal slot.

4. The chair of claim 3 wherein said vertical adjustment means comprises an extending member received within said longitudinal slot, said lumbar support pad being vertically adjustable by vertical movement thereof with respect to said extending member.

5. The chair of claim 3 wherein said extending member is received in sliding engagement in said stationary support means.

6. The chair of claim 4 wherein said longitudinal slot is defined by a collar having a plurality of protrusions, and said extending member comprises a plurality of structures complementary to said protrusions, said protrusions defining increments of vertical movement of said lumber support pad.

7. The chair of claim 6 wherein said protrusions each comprise a recess and said stationary support means comprises a plurality of bosses engageable in said recesses, to secure the vertical position of said lumbar pad.

* * * * *